United States Patent [19]

Miyakawa

[11] Patent Number: 4,495,268

[45] Date of Patent: Jan. 22, 1985

[54] ELECTROPHOTOGRAPHIC PROCESS USING TRANSFER-TYPE ONE-COMPONENT MAGNETIC DEVELOPER

[75] Inventor: Nobuhiro Miyakawa, Suita, Japan

[73] Assignee: Mita Industrial Co., Ltd., Osaka, Japan

[21] Appl. No.: 393,802

[22] Filed: Jun. 30, 1982

Related U.S. Application Data

[63] Continuation of Ser. No. 217,579, Dec. 18, 1980.

[30] Foreign Application Priority Data

Dec. 25, 1979 [JP] Japan ..... 54-167594

[51] Int. Cl.[3] ..... G03G 9/14

[52] U.S. Cl. ..... 430/122; 430/903; 430/106.6

[58] Field of Search ..... 430/106.6, 903, 107, 430/122

[56] References Cited

U.S. PATENT DOCUMENTS

| | | | |
|---|---|---|---|
| 4,108,786 | 8/1978 | Takayama et al. | 430/903 |
| 4,142,981 | 3/1979 | Bean et al. | 430/107 |
| 4,272,600 | 6/1981 | Sypula et al. | 430/106 |
| 4,311,779 | 1/1982 | Muyakawa et al. | 430/107 |
| 4,315,064 | 2/1982 | Muyakawa et al. | 430/122 |

*Primary Examiner*—John D. Welsh

*Attorney, Agent, or Firm*—Sherman & Shalloway

[57] ABSTRACT

Disclosed is a transfer-type one-component dry magnetic developer which comprises a binder medium having a high electric resistance and particles of triiron tetroxide of an isometric system having a particle size of 0.25 to 1 micron and a coercive force of 30 to 80 Oe, in which the triiron tetroxide particles are dispersed in the binder medium.

This developer provides a transferred image excellent in the density, sharpness and clarity on a plain paper as a transfer sheet in the electrostatic photography.

7 Claims, 3 Drawing Figures

ELECTROPHOTOGRAPHIC PROCESS USING TRANSFER-TYPE ONE-COMPONENT MAGNETIC DEVELOPER

This is a continuation of application Ser. No. 217,579, filed Dec. 18, 1980.

BACKGROUND OF THE INVENTION (1) Field of the Invention

The present invention relates to a transfer type one-component magnetic developer for use in the electrostatic photography. More particularly, the present invention relates to a one-component dry magnetic developer suitable for use in the electrostatic photographic process in which an electrostatic latent image formed on a photosensitive plate and the developed image is transferred onto a plain paper as a transfer sheet to form a reproduced or printed image.

(2) Description of the Prior Art

As the developer capable of developing an electrostatic latent image without using a particular carrier, so-called one-component or carrierless magnetic developers comprising a finely divided magnetic material incorporated in developer particles are known and broadly used in the field of electrostatic photography.

As one type of such one-component magnetic developer, there is known a so-called conductive magnetic developer in which a finely divided magnetic material is incorporated in developer particles to impart a magnetically attractable property and a conducting agent such as conductive carbon black is distributed on the surfaces of the particles to impart an electric conductivity (see the specifications of U.S. Pat. No. 3,639,245 and No. 3,965,022). It is known that when this conductive magnetic developer is brought into contact in the form of a so-called magnetic brush with an electrostatic latent image-supporting plate to effect development of the latent image, an excellent visible image free of a so-called edge effect or fogging is obtained. However, it also is known that a serious problem arises when this image of the developer is transferred to an ordinary transfer sheet. More specifically, as disclosed in Japanese Patent Application Laid-Open Specification No. 117435/75, if the inherent electric resistance of a transfer sheet used is lower than $3\times10^{13}$ Ω-cm as in case of a plain paper, broadening of the contour of the transferred image or reduction of the transfer efficiency is readily caused by scattering of developer particles. This defect may be moderated to some extent if a resin, wax or oil having a high electric resistance is coated on the toner-receiving surface of a transfer sheet, but this improving effect is relatively low under a high humidity condition. Furthermore, the cost of transfer sheets is increased by coating with a resin or the like, and the touch or feel is reduced by the presence of such coating.

As another type of the one-component magnetic developer, there is known a one-component non-conductive magnetic developer comprising particles of a homogeneous and intimate mixture of a finely divided magnetic material and an electricity-detecting binder. For example, the specification of U.S. Pat. No. 3,645,770 discloses an electrostatic photographic reproduction process in which a magnetic brush (layer) of such non-conductive magnetic developer is charged by corona discharged with a polarity opposite to the polarity of an electrostatic latent image to be developed, the charged developer is brought into contact with an electrostatic latent image-supporting plate to develop the latent image and the formed developer image is transferred onto a transfer sheet. This electrostatic photographic reproduction process is advantageous in that a transfer image can be formed even on a plain paper as a transfer sheet. However, this process is insufficient in some points. For example, it is difficult to uniformly charge the magnetic brush of the non-conductive magnetic developer entirely even to the deep root portion thereof, and it is ordinarily difficult to form an image having a sufficient density. Furthermore, since a corona discharge mechanism should be arranged in the zone of a developing device, the structure of the copying apparatus becomes complicated.

There have recently been proposed a process in which an electrostatic latent image is developed by utilizing charging of a non-conductive magnetic developer owing to frictional contact of the developer with the surface of an electrostatic latent image-supporting plate (see Japanese Patent Application Laid-Open Specification No. 62638/75) and a process in which development is carried out by utilizing dielectric polarization of a non-conductive magnetic developer (see Japanese Patent Application Laid-Open Specification No. 133026/76). In the former process, the development conditions should strictly be controlled, and if the development conditions are not strictly controlled, fogging is readily caused in a non-image area (occurrence of fogging is especially conspicuous when the degree of contact between the surface of a photosensitive material and the top ends of spikes of magnetic toner particles is high) or fixing or blocking of magnetic toner particles on a developing sleeve is caused. These defects become serious when the reproduction operation is continuously conducted. In the latter process, the problem of fogging does not arise, but since an electrostatic latent image is converted to a visible image by the developing charges produced by a dielectric polarizing effect induced by the magnetic toner, a low-potential portion of the latent image is not effectively developed. Therefore, a low-density portion of an original is not effectively reproduced and it is difficult to reproduce a half tone in a print.

Furthermore, copies obtained according to the above two processes lack a sharpness, and if a p-type photosensitive material such as selenium is used for a photosensitive plate and a positively charged image is developed, according to any of these two processes, it is difficult to form images having a sufficiently high density.

SUMMARY OF THE INVENTION

It has been found that when triiron tetroxide particles of an isometric system having a particle size of 0.25 to 1 micron and a coercive force of 30 to 80 Oe are selected and used as the magnetic powder to be dispersed in a binder medium having a high electric resistance and when the resulting one-component magnetic developer is used for development of a positively charged image on a photosensitive plate and transfer of the developed image onto a plain paper, there can be obtained a transferred image which is prominently excellent in density, sharpness and clarity. The present invention is based on this finding.

It is therefore a primary object of the present invention to provide a one-component dry magnetic developer which can form a transferred image excellent in density, sharpness and clarity on a plain paper as a transfer sheet.

Another object of the present invention is to provide a one-component dry magnetic developer which has such a characteristic property that for development of an electrostatic latent image with this developer, a particular accessory device such as a corona discharge mechanism need not be used, development can be performed very effectively without excessive frictional contact of a magnetic brush of the developer with the surface of a photosensitive layer and an image of the developer can be transferred onto an uncoated plain paper without broadening of the contour or reduction of the transfer efficiency.

Still another object of the present invention is to provide a one-component dry magnetic developer which is excellent in the property of reproducing a half tone.

In accordance with the present invention, there is provided a transfer-type one-component dry magnetic developer which comprises a binder medium having a high electric resistance and particles of triiron tetroxide of an isometric system having a particle size of 0.25 to 1 micron and a coercive force of 30 to 80 Oe, said triiron tetroxide particles being dispersed in the binder medium.

DETAILED DESCRIPTION OF THE PREFERRED EMBODIMENTS

The present invention will now be described in detail.

When a magnetic brush of a one-component magnetic developer is brought into contact with the surface of a plate supporting an electrostatic latent image thereon, both the electrostatic attracting force (Coulomb force) and the magnetic attracting force are produced between the developer particles and the electrostatic latent image and between the developer particles and a magnetic brush-forming magnet, respectively. Accordingly, developers on which the Coulomb force is larger are attracted to the electrostatic latent image and developer particles on which the magnetic attracting force is larger are attracted to the developing sleeve, whereby a developed image is formed according to the electrostatic latent image on the plate. Therefore, it is required for the one-component magnetic developer that a certain balance should be maintained between the magnetic characteristic and the charging characteristic at the developing step.

When the developer image is transferred onto a transfer sheet, corona discharge of a polarity opposite to that of the retained charges of the developer, that is, the same polarity as that of the electrostatic latent image on the photosensitive plate, is applied from the back surface of the transfer sheet to attract the developer image toward the transfer sheet. However, if the retained charges of the developer particles are readily extinguished or neutralized on the transfer sheet, the developer particles are scattered around or repelled toward the photosensitive plate, with the result that broadening of the transferred image or reduction of the transfer efficiency is caused. Accordingly, although the one-component magnetic developer contains a relatively large amount of the magnetic material powder, the magnetic developer is required to have such a property that the charges are stably retained.

The most important characteristic feature of the present invention is that triiron tetroxide particles of an isometric system having a particle size of 0.25 to 1 micron and a coercive force of 30 to 80 Oe are selected as the finely divided magnetic material and this specific finely divided magnetic material is dispersed in a binder medium having a high electric resistance to form a one-component dry developer which has not only an electrically insulating property but also a magnetic property.

Figure 1:
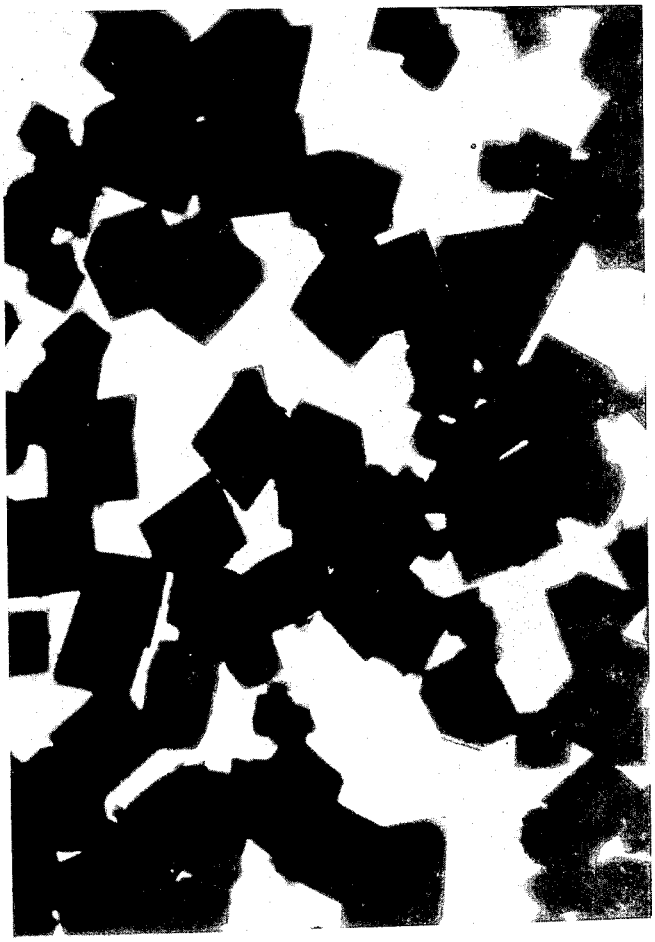
FIG. 1 is an electron microscope photograph (30000 magnifications) of an example of triiron tetroxide of an isometric system that is used in the present invention.

The finely divided magnetic material that is used in the present invention should be triiron tetroxide having an isometric system as shown in an electron microscope of FIG. 1. Various kinds of triiron tetroxide differing in the crystal system, for example, triiron tetroxide of a needle system and triiron tetroxide of an isometric system, are known. As will readily be understood from the Examples given hereinafter, when triiron tetroxide of an isometric system is used, the density of the transferred image can be improved remarkably over the density obtained by the use of triiron tetroxide of a needle system. The reason has not been elucidated completely. It is believed, however, that the above improvement may probably be attained for the following reason. In a one-component magnetic developer, the development efficiency and transfer efficiency have close relations to the electrostatic capacitance and dielectric constant of the developer. The developer of the present invention ordinarily has a relatively small electrostatic capacitance of 7 to 9.5 pF (picofarad) and a relatively low dielectric constant of 3.5 to 4.9, each being determined under conditions of an electrode spacing of 0.65 mm, an electrode sectional area of 1.43 $cm^2$ and an inter-electrode load of 105 $g/cm^2$. On the other hand, in the conventional one-component magnetic developer formed by using triiron tetroxide of a needle system, either the electrostatic capacitance or the dielectric constant is outside the above-mentioned range, and such developer is still unsatisfactory for attaining the object of improving the density, sharpness and clarity in the transferred image. In contrast, if the above-mentioned specific magnetic material is used according to the present invention, since the dielectric constant of the developer is controlled to a relatively low level, the respective particles are readily charged, and since the electrostatic capacitance of the developer is controlled to a relatively low level, the tendency of charges of escape from the developer particles is moderated, with the result that both the development efficiency and the transfer efficiency are increased.

Furthermore, it is considered that use of triiron tetroxide of an isometric system facilitates uniform dispersion of the finely divided magnetic material in the binder medium having a high electric resistance and is effective for providing a developer which has an excellent flowability as powder and an electrically insulating property as a whole.

In order to increase the density of the transferred image, it is very important triiron tetroxide of an isometric system that is used in the present invention should have a particle size of 0.25 to 1 micron, preferably 0.3 to 0.7 micron, and a coercive force (Hc) of 30 to 80 Oe, preferably 40 to 70 Oe. More specifically, as will be apparent from Examples give hereinafter, if the particle size and coercive force are within the above-mentioned ranges, the density of the transfer image is remarkably improved over the image density attained when the particle size and coercive force are outside the above-mentioned ranges.

In the instant specification and appended claims, by the term "particle size" is meant an average value of lengths of one sides of triiron tetroxide particles of an isometric system as measured on an electron microscope photograph.

It is known that the magnetic attractive force of a magnetic developer is proportional to the cube of the particle size of magnetic particles used. If the particle size is outside the above-mentioned range, the development efficiency is reduced, and when the particle size is smaller than the lower limit of the above range, scattering of developer particles or contamination of the background (so-called fogging) becomes conspicuous. If the coercive force (Hc) is larger than the upper limit of the above range, the development efficiency is reduced and the image density is lowered. If the coercive force is smaller than the lower limit of the above-mentioned range, contamination of the background (fogging) or broadening of the contour is readily caused.

In order to improve the density of the transferred image, it is preferred that in triiron tetroxide of an isometric system that is used in the present invention, the bulk density/coercive force ratio be at least 0.0045 g/ml·Oe, especially at least 0.007 g/ml·Oe.

In the instant specification and appended claims, the bulk density (g/ml) is one determined according to the Method K-5101 of JIS (Japanese Industrial Standard).

Triiron tetroxide having the above-mentioned particle size characteristic and crystal form, that is used in the present invention, has a bulk density much larger than that of other triiron tetroxide and it also has a relatively small coercive force (Hc). Accordingly, the value of the bulk density/coercive force ratio of this triiron tetroxide is large, and as will be apparent from Examples given hereinafter, the density of the transferred image is increased substantially in proportion to the value of this ratio.

Triiron tetroxide having the above-mentioned characteristics may be prepared according to the following process, though the preparation process is not limited to one described below.

An aqueous solution of sodium hydroxide is added to an aqueous solution of iron (III) sulfate to form a precipitate of iron (III) hydroxide. The pH value of the mother liquor is adjusted to 4 to 11 and the precipitate is subjected to a hydrothermic treatment under pressure to convert the gel-like precipitate of iron hydroxide to cubic $\alpha$-$Fe_2O_3$ (hematite). Conditions for formation of such cubic diiron trioxide are described in detail, for example, in Nobuoka et al, Kogyo Kagaku Zasshi, 66, page 412 (1963). The hydrothermic treatment may be carried out at a temperature of 150° to 230° C. for 10 to 100 hours. Ordinarily, the higher is the pH value of the mother liquor, the larger is the particle size of the product, and $\alpha$-diiron trioxide having a predetermined particle size can be obtained by adjusting the pH value of the mother liquor and the treament temperature and time as well. The so obtained $\alpha$-diiron trioxide is subjected to a reducing treatment under known conditions, for example, at 400° C. with hydrogen in a reducing furnace, whereby triiron tetroxide ($Fe_3O_4$) having an isometric system is obtained. The reducing treatment is carried out so that the $Fe^{2+}/Fe^{3+}$ atomic ratio in the resulting triiron tetroxide is in the range of from 0.9/1.0 to 1.0/1.0. Thus, triiron tetroxide of an isometric system having the above-mentioned characteristics can be obtained.

Figure 2:
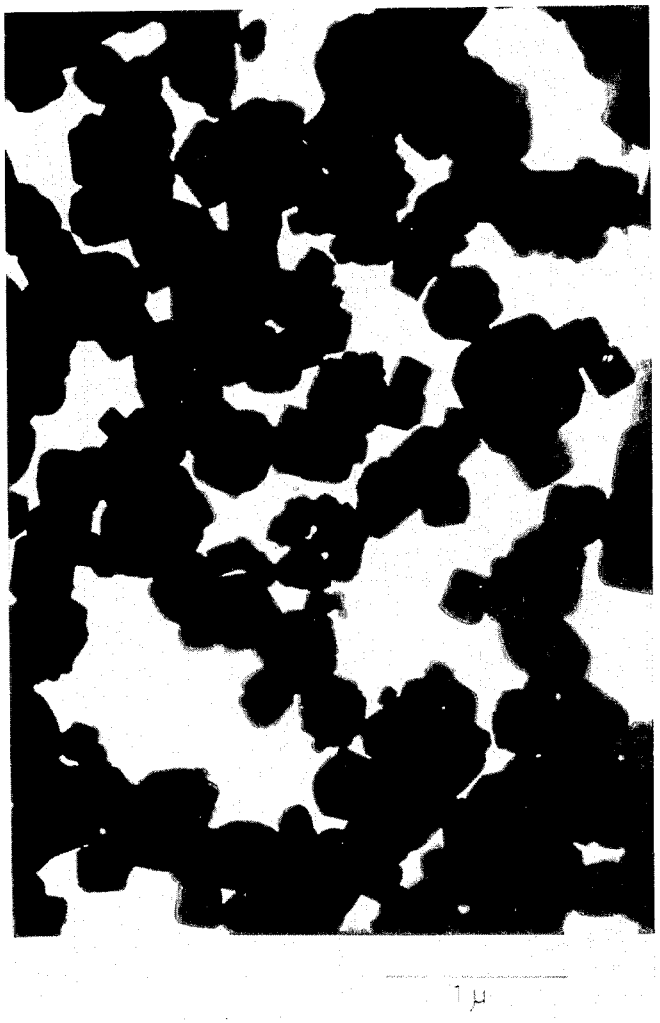
FIG. 2 is an electron microscope photograph (30000 magnifications) of another example of triiron tetroxide of an isometric system that is used in the present invention.

If the hydrothermic treatment for preparation of $\alpha$-diiron trioxide as the precursor is carried out at a relatively low pH value, it sometimes happens that there is obtained triiron tetroxide of an isometric system having a somewhat rounded cubic crystal form in which corners are rounded as shown in an electron microscope of FIG. 2. In the present invention, such isometric triiron tetroxide can satisfactorily be used so far as the above-mentioned requirements are satisfied.

As the binder medium in which triiron tetroxide of an isometric system is dispersed, there may be used resins, waxy substances and rubbers which show an appropriate fixing property under application of heat or pressure. A mixture of two or more of these substances may be used as the binder medium. In the present invention, it is preferred that the binder medium used should have a volume resistivity higher than $1\times10^{15}$ Ω-cm as measured in the state where triiron tetroxide is not incorporated.

Homopolymers and copolymers of various mono- and di-ethylenically unsaturated monomers, especially (a) vinyl aromatic monomers and (b) acrylic monomers.

As the vinyl aromatic monomer, there are preferably used monomers represented by the following formula:

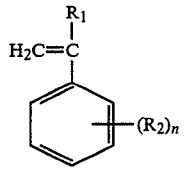

wherein $R_1$ stands for a hydrogen atom, a lower alkyl group (having up to 4 carbon atoms) or a halogen atom, $R_2$ stands for a substituent such as a lower alkyl group or a halogen atom, and n is a number of 0, 1 or 2, such as styrene, vinyltoluene, $\alpha$-methylstyrene, $\alpha$-chlorostyrene, vinylxylene and vinylnaphthalene. Among these monomers, styrene and vinyltoluene are especially preferred.

As the acrylic monomer, there are preferably used monomers represented by the following formula:

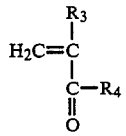

wherein $R_3$ stands for a hydrogen atom or a lower alkyl group, and $R_4$ stands for a hydroxyl group, an alkoxy group, a hydroxyalkoxy group, an aminoalkoxy group or an amino group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As other monomer to be used alone or in combination with the above monomer (a) or (b), there can be mentioned, for example, conjugated diolefin monomers represented by the following formula:

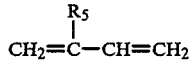

wherein $R_5$ stands for a hydrogen atom, a lower alkyl group or a chlorine atom, such as butadiene, isoprene and chloroprene, ethylenically unsaturated carboxylic acids and esters thereof such as maleic anhydride, fumaric acid, crotonic acid and itaconic acid, vinyl esters such as vinyl acetate, and vinylpyridine, vinylpyrrolidone, vinyl ether, acrylonitrile, vinyl chloride and vinylidene chloride.

It is preferred that the molecular weight of such vinyl polymer be 3000 to 300000, especially 5000 to 200000.

In the present invention, it is preferred that the binder medium be used in an amount of 60 to 125% by weight, especially 75 to 110% by weight, based on triiron tetroxide of an isometric system. Triiron trioxide is kneaded homogeneously and intimately with this binder medium and the kneaded mixture is pulverized to form a one-component dry magnetic developer.

Prior to the above kneading and pulverizing operations, known auxiliary components may be incorporated according to known recipes. For example, in order to improve the color tone of the developer, at least one member selected from pigments such as carbon black and dyes such as Acid Violet (C.I. 43525) may be used in an amount of 0.5 to 5% by weight based on the total developer composition. In order to attain an extending effect, a filler such as calcium carbonate or finely divided silicic acid may be added in an amount of up to 20% by weight based on the total developer composition. When a fixing method using a heating roll for fixation is adopted, an offset-preventing agent such as a silicone oil, a low-molecular-weight olefin resin or a wax may be used in an amount of 2 to 15% by weight based on the total developer composition. When a fixing method using a pressure roll for fixation is adopted, a pressure fixation-promoting agent such as a paraffin wax, an animal or vegetable wax or a fatty acid amide may be used in an amount of 5 to 30% by weight based on the total developer composition. In order to prevent cohesion or agglomeration of developer particles and improve the flowability of the developer, a flowability-improving agent such as finely divided polytetrafluoroethylene may be incorporated in an amount of 0.1 to 1.5% by weight based on the total developer composition.

Shaping of the developer is accomplished by cooling the above-mentioned kneaded composition, pulverizing the cooled composition and, if necessary, classifying the pulverized composition. Of course, mechanical rapid stirring may be conducted to round sharp corners of amorphous particles.

It is ordinarily preferred that the particle size of the developer particles be in the range of from 5 to 35 microns, though the preferred particle size varies to some extent according to the desired resolving power. When the so prepared developer comprising amorphous particles formed by kneading and pulverization is used according to the present invention, effects of increasing the transfer efficiency and improving the image sharpness can be attained.

In the electrostatic photographic reproduction process using the developer of the present invention, formation of an electrostatic latent image is accomplished according to known procedures. For example, a photoconductive layer on a conductive substrate is uniformly charged and is then subjected to imagewise exposure to form an electrostatic latent image.

A magnetic brush of the above-mentioned one-component magnetic developer is brought into contact with the electrostatic latent image-supporting surface of the substrate to form a visible image of the developer.

Figure 3:
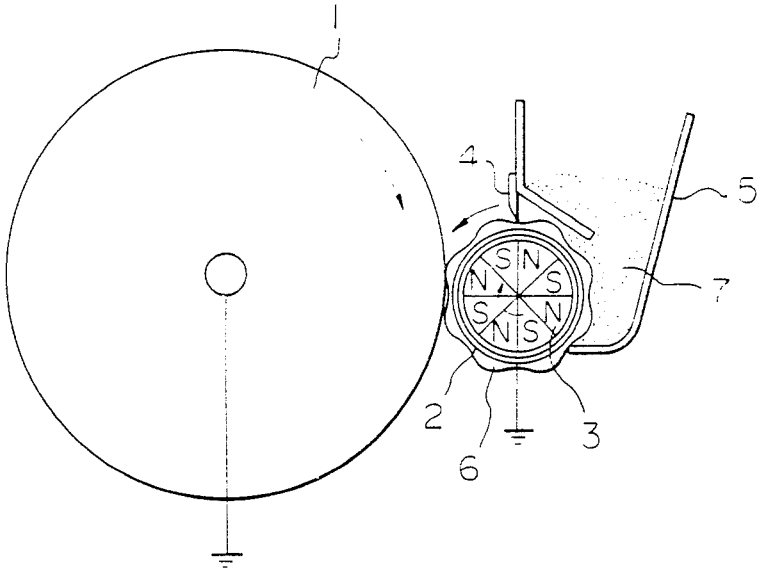
FIG. 3 is a diagram illustrating a developing process using the one-component magnetic developer of the present invention.

Referring to FIG. 3 illustrating a developing process suitable for carrying out the present invention, the above-mentioned one-component magnetic developer 7 is supplied in a developer hopper 5. A non-magnetic sleeve 2 is disposed on an opening on the lower end of the hopper 5 so that the sleeve 2 can rotate in a direction indicated by an arrow, and a magnet 3 is arranged within the sleeve 2 so that the magnet 3 can rotate in a direction opposite to the rotation direction of the sleeve 2. When the sleeve 2 and magnet 3 are rotated, a brush layer 6 of the magnetic developer is formed on the sleeve 2, and it is cut into an appropriate length by a spike-cutting plate 4 and is lightly contacted with a selenium drum 1 rotating in the same direction as the rotation direction of the sleeve 2. An electrostatic latent image (not shown) on the selenium drum 1 is developed by the magnetic developer.

Then, the so formed image of the developer on the substrate is contacted with a transfer sheet, and corona discharge is conducted at the same polarity as that of the above-mentioned electrostatic latent image from the back surface of the transfer sheet to transfer the developer image onto the transfer sheet.

In the present invention, fixation of the transferred image is accomplished according to a heating roller fixation method, a flash lamp fixation method or a pressing roller fixation method, which is optionally selected according to the kind of the developer.

The developer of the present invention is especially suitable for the development treatment of a positively charged latent image formed on a p-type photosensitive plate, such as a selenium photosensitive plate or an organic photoconductor photosensitive plate. Conventional one-component magnetic developers of the frictional charging type can be used for development on negatively charged latent image-carrying photosensitive plates, but when they are used for development of positively charged latent images on p-type photosensitive plates such as mentioned above, only unsatisfactory results are obtained. In contrast, the developer of the present invention exert excellent effects in developing a positively charged latent image and transferring the developed image.

The present invention will now be described in detail with reference to the following Examples that by no means limit the scope of the invention. Incidentally, in these Examples, all of "parts" are by weight unless otherwise indicated.

EXAMPLE 1

By using a two-roll kneader, 220 parts of magnetite shown in Table 1 is kneaded under fusing conditions with 166 parts of a vinyltoluene/acrylic monomer copolymer (supplied by Goodyear Co. and having a weight average molecular weight of 83000), 14 parts of low-molecular-polypropylene (Viscol 550-P supplied by Sanyo Chemical Co.) and 2.7 parts of a negative charge-controlling agent (Bontron R-04 manufactured by Orient Chemical Industry Co.). The kneaded mixture was naturally cooled and was then roughly pulverized by a cutting mill to obtain a pulverization product having a size of 0.5 to 2 mm. Then, the pulverization product was finely pulverized by a jet mill and classified by a zigzag classifier to obtain a magnetic toner having a particle size of 5 to 25μ.

For the above procedures, there were used magnetities of a needle system and of an isometric system having the coercive force, bulk density and particle size shown in Table 1. Incidentally, the coercive force was measured by using a magnetic property-measuring device (Model VSMP-1 manufactured by Toei Industrial Co. and having a magnetic field of 5K Oe), the bulk density was determined according to the Method of JIS K-5101, and the particle size was determined from an electron microscope photograph.

TABLE 1

| Crystal System of Magnetite | Coercive Force (Oe) | Bulk Density (g/ml) | Particle Size (μ) |
|---|---|---|---|
| needle (A) | 350 | 0.40 | 0.5–0.6 in length and 0.06–0.1 in width |
| needle (B) | 370 | 0.78 | 0.5–0.7 in length and 0.05–0.1 in width |
| isometric (present invention 1) | 64 | 0.35 | 0.3–0.7 |
| isometric (present invention 2) | 50 | 0.47 | 0.4 |

Magnetic toners prepared by using magnetites of needle (A), needle (B), present invention 1 and present invention 2 in Table 1 are designated as toners (A), (B), 1 and 2, respectively.

By using the so prepared magnetic toners, the copying test was carried out according to the following procedures.

In a copying machine comprising a selenium drum having an outer diameter of 150 mm as the photosensitive material, the magnetic toner was applied to a developing roller of the so-called two-rotation system for rotating a magnet and a sleeve independently. The intensity of the magnetic field on a developing sleeve (having an outer diameter of 33 mm) having a magnet installed therein through a nonmagnetic member was adjusted to about 900 gauss. The distance between the sleeve and a spike-cutting plate was adjusted to 0.3 mm. A hopper was arranged so that the magnetic toner was supplied from the hopper to the developing roller, and the distance between the surface of the photosensitive material and the developing roller was adjusted to 0.5 mm. The developing sleeve and photosensitive material were rotated in the same direction, and the magnet was rotated in the opposite direction. Under these conditions, charging (+6.7 KV), imagewise exposure, development, transfer (+6.3 KV), heating roller fixation and fur brush cleaning were carried out. Wood free paper having a thickness of 80μ was used as the transfer sheet. The results of the copying test and the properties of the respective magnetic toners are shown in Table 2. The image density was determined by measuring the density of the solid black area by using a commercially available reflection densitometer (manufactured by Konishiroku Photographic Industry Co.), and the electrostatic capacitance was measured by using a commercially available LC meter (manufactured by Kokuyo Electric Co.), a commercially available power source and a commercially available ampere meter (manufactured by Takeda-Riken Co.) in combination.

A cell used for measuring the properties of the magnetic toners comprised an electrode portion formed of a stainless steel and an insulating portion formed of quartz, and the measurement was conducted under conditions of an electrode spacing of 0.65 mm, an electrode sectional area of 1.43 $cm^2$, an inter-electrode load of 105 $g/cm^2$, a temperature of 20° to 25° C. and an atmosphere relative humidity of 55 to 65%.

TABLE 2

| Magnetic Toner | Volume Resistivity (Ω-cm) | Electrostatic Capacitance (pF) | Dielectric Constant | Image Density at Continuous Copying: first print | Image Density at Continuous Copying: 100-th print | Stability of Image Density |
|---|---|---|---|---|---|---|
| (A) | $2.2 \times 10^{14}$ | 11.1 | 5.69 | 0.71 | 0.29 | bad |
| (B) | $1.5 \times 10^{14}$ | 10.3 | 5.28 | 0.64 | 0.27 | bad |
| 1 | $4.4 \times 10^{14}$ | 8.3 | 4.26 | 1.20 | 1.18 | good |
| 2 | $7.7 \times 10^{14}$ | 8.0 | 4.10 | 1.26 | 1.19 | good |

In case of the magnetic toners prepared by using magnetite of a needle system, the image density was low, and reduction of the image density was caused at the continuous copying operation. On the other hand, in case of the magnetic toners prepared by using magnetite of an isometric system, the image density was high and reduction of the image density was hardly caused at the continuous copying operation.

EXAMPLE 2

By using the magnetite used in Example 1 (magnetite of present invention 1), magnetic toners were prepared in the same manner as described in Example 1 except that the mixing ratios of the resin and other components were changed as shown in Table 3. By using the so prepared magnetic toners, the copying test was carried out in the same manner as described in Example 1. The results of the copying test and the properties of the magnetic toners are shown in Table 4. Incidentally, in Table 4, the sharpness was evaluated on the degree of clear cut in the line image area of the obtained copy.

TABLE 3

| Magnetic Toner No. | Composition (parts by weight): Magnetite | Resin | Low-Molecular-Weight Polypropylene | Negative Charge Controlling Agent |
|---|---|---|---|---|
| 1 | 60 | 32.5 | 7.5 | 1.6 |
| 2 | 55 | 37.5 | 7.5 | 1.8 |
| 3 | 50 | 42.5 | 7.5 | 2.0 |
| 4 | 45 | 47.5 | 7.5 | 2.2 |
| 5 | 40 | 52.5 | 7.5 | 2.4 |

TABLE 4

| Magnetic Toner No. | Volume Resistivity (Ω-cm) | Electrostatic Capacitance (pF) | Dielectric Constant | Image Density | Sharpness (Image Quality) |
|---|---|---|---|---|---|
| 1 | $1.7 \times 10^{14}$ | 9.30 | 4.77 | 1.12 | good |
| 2 | $3.2 \times 10^{14}$ | 9.15 | 4.69 | 1.20 | good |
| 3 | $4.5 \times 10^{14}$ | 9.00 | 4.62 | 1.24 | good |
| 4 | $7.3 \times 10^{14}$ | 8.95 | 4.59 | 1.31 | fair |
| 5 | $1.5 \times 10^{15}$ | 8.80 | 4.51 | 1.34 | ordinary (scattering of toner) |

EXAMPLE 3

By using 10 kinds of magnetites having properties shown in Table 5, magnetic toners were prepared in the same manner as described in Example 1, except that after classification, hydrophobic silica (R-972 supplied by Nippon Aerosil Co.) was incorporated in an amount of 0.2% by weight based on the total composition, a vinyltoluene/butadiene copolymer (supplied by Goodyear Co. and having a weight average molecular weight of 78000) was used as the resin and Spiron Black BHH (supplied by Hodogaya Chemical Co.) was used as the charge controlling agent.

By using the so prepared magnetic toners, the copying test was carried out in the same manner as described in Example 1. The results of the copying test and the properties of the magnetic toners are shown in Table 6.

In Table 5, magnetites (a) to (f) are comparative magnetites, and magnetites (g) to (j) are those included in the scope of the present invention. Electron microscope photographs of the magnetites (i) and (g) are shown in FIGS. 1 and 2, respectively.

Incidentally, magnetites having a high coercive force could be obtained by adding an aqueous solution of cobalt sulfate at the step of reacting the aqueous solution of iron (III) sulfate with the aqueous solution of sodium hydroxide to form and precipitate iron (III) hydroxide containing cobalt.

In Table 6, magnetic toners (a) to (j) are those prepared by using the magnetites (a) to (j) shown in Table 5, respectively. The sharpness was evaluated in the same manner as described in Example 2, and scattering of the toner was checked on the obtained copy.

The volume resistivity of each magnetic toner was in the range of from $1.5 \times 10^{14}$ to $5 \times 10^{14}$ Ω-cm. Therefore, the volume resistivity was not shown in Table 6.

TABLE 5

| Magnetite | Coercive Force (Oe) | Bulk Density (g/ml) | Particle Size (μ) | (Bulk Density/Coercive Force) $\times 10^{-3}$ |
|---|---|---|---|---|
| (a) | 72 | 0.40 | 0.2 | 5.56 |
| (b) | 98 | 0.40 | 0.3 | 4.08 |
| (c) | 85 | 0.37 | 0.3–0.4 | 4.35 |
| (d) | 134 | 0.31 | 0.27 | 2.31 |
| (e) | 410 | 0.32 | 0.1–0.3 | 0.78 |
| (f) | 213 | 0.55 | 0.4–0.5 | 2.58 |
| (g) | 64 | 0.4 | 0.3–0.6 | 6.25 |
| (h) | 49 | 0.47 | 0.4 | 9.59 |
| (i) | 56 | 0.71 | 0.5 | 12.7 |
| (j) | 41 | 0.53 | 0.5 | 12.9 |

TABLE 6

| Magnetic Toner | Electrostatic Capacitance (pF) | Dielectric Constant | Image Density | Scattering of Toner | Sharpness (Image Quality) |
|---|---|---|---|---|---|
| (a) | 7.9 | 4.05 | 0.85 | observed | ordinary |
| (b) | 9.0 | 4.62 | 0.65 | slight | ordinary |
| (c) | 9.0 | 4.62 | 0.61 | slight | ordinary |

TABLE 6-continued

| Magnetic Toner | Electrostatic Capacitance (pF) | Dielectric Constant | Image Density | Scattering of Toner | Sharpness (Image Quality) |
|---|---|---|---|---|---|
| (d) | 8.0 | 4.10 | 0.47 | observed | bad |
| (e) | 9.2 | 4.72 | 0.40 | observed | bad |
| (f) | 8.0 | 4.10 | 0.62 | not observed | ordinary |
| (g) | 7.6 | 3.90 | 1.20 | not observed | good |
| (h) | 8.2 | 4.21 | 1.26 | not observed | good |
| (i) | 7.9 | 4.05 | 1.31 | not observed | good |
| (j) | 8.0 | 4.10 | 1.30 | not observed | good |

When a styrene resin (D-125 supplied by Esso-Standard Co.) was used instead of the vinyltoluene/butadiene copolymer and magnetic toners were prepared and tested, there were obtained results similar to those shown in Table 6. However, when an epoxy resin or a polyester resin was used, even if magnetite included in the scope of the present invention was used, the image density was lower than 0.8 in obtained prints.

What is claimed is:

1. In an electrostatic photographic copying process comprising causing a p-type photosensitive plate carrying a positively charged latent image thereon to come in contact with a magnetic brush of a one-component dry magnetic developer to effect development of the electrostatic latent image and electrostatically transferring the formed image of the developer onto a transfer sheet, the improvement wherein the magnetic developer consists essentially of particles having a particle size of from 5 to 35 microns and being obtained by kneading triiron tetroxide homogeneously and intimately with a binder medium, cooling the kneaded composition, pulverizing the cooled composition and classifying the pulverized composition, said binder medium comprising a polymer comprising at least one of vinyl aromatic monomer or acrylic monomer units and having a volume resistivity higher than $1 \times 10^{15}$ ohm-cm and particles of triiron tetroxide dispersed in the binder medium, said triiron tetroxide being one of an isometric system having a particle size of 0.25 to 1 micron and a coercive force of 30 to 80 Oe, said binder medium being present in an amount of 60 to 125 percent by weight based on the triiron tetroxide, said developer having a volume resistivity of at least $1.5 \times 10^{14}$ ohm-cm, a dielectric constant of from 3.5 to 4.9 as measured under conditions of an electrode spacing of 0.65 mm, an electrode sectional area of 1.43 $cm^2$ and an inter-electrode load of 105 $g/cm^2$ and an electrostatic capacitance of from 7 to 9.5 pF as measured under said conditions.

2. The process of claim 1 wherein the triiron tetroxide has a bulk density/coercive force ratio of from 0.0045 to 0.020 g/ml.Oe.

3. The process of claim 1 wherein the triiron tetroxide has a particle size of 0.3 to 0.7 micron and a coercive force of 40 to 70 Oe.

4. The process of claim 1 wherein the vinyl aromatic monomer has the formula:

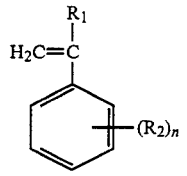

wherein $R_1$ stands for a hydrogen atom, a lower alkyl group having up to 4 carbon atoms or a halogen atom, $R_2$ stands for a substituent such as a lower alkyl group or a halogen atom, and n is a number of 0, 1 or 2 and wherein the acrylic monomer has the formula

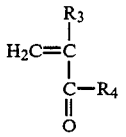

wherein $R_3$ stands for a hydrogen atom or a lower alkyl group, and $R_4$ stands for a hydroxyl group, an alkoxy group, a hydroxyalkoxy group, an aminoalkoxy group or an amino group.

5. The process of claim 1 wherein the binder medium comprises a homopolymer or copolymer of styrene or vinyl toluene.

6. The process of claim 1 wherein the step of electrostatically transferring the formed image of the developer onto a transfer sheet comprises subjecting the back surface of the transfer sheet to corona discharge of positive polarity and bringing the image of the developer into contact with the transfer sheet whereby the image is electrostatically transferred onto the transfer sheet.

7. In an electrostatic photographic copying process in which a p-type photosensitive plate, such as selenium or organic photoconductor, carrying a positively charged latent image thereon is contacted with a magnetic brush of a one-component dry magnetic developer to effect development of the electrostatic latent image and electrostatically transferring the formed image of the developer onto a transfer sheet the back surface of which has been charged to a positive polarity, the improvement which comprises using a magnetic developer consisting essentially of particles having a particle size in the range of 5 to 35 microns and comprising amorphous particles of triiron tetroxide of an isometric system with a particle size of 0.3 to 0.7 micron and a coercive force of 40 to 70 Oe, said amorphous particles being uniformly and intimately dispersed throughout a binder medium of a high volume resistivity of at least $1\times10^{15}$ ohm-cm, said binder medium comprising a polymer of a vinyl aromatic monomer of formula

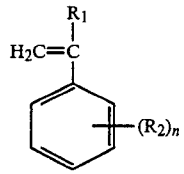

wherein $R_1$ stands for a hydrogen atom, a lower alkyl group having up to 4 carbon atoms or a halogen atom, $R_2$ stands for a substituent such as a lower alkyl group or a halogen atom, and n is a number of 0, 1 or 2 or an acrylic monomer of formula

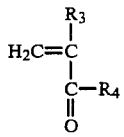

wherein $R_3$ stands for a hydrogen atom or a lower alkyl group, and $R_4$ stands for a hydroxyl group, an alkoxy group, a hydroxyalkoxy group, an aminoalkoxy group or an amino group or both said monomers, said binder medium being present in an amount of 60 to 125 percent by weight based on the triiron tetroxide, said developer having a volume resistivity of at least $1.5\times10^{14}$ ohm-cm, a dielectric constant of from 3.5 to 4.9 as measured under conditions of an electrode spacing of 0.65 mm, an electrode sectional area of 1.43 $cm^2$ and an inter-electrode load of 105 $g/cm^2$ and an electrostatic capacitance of from 7 to 9.5 pF as measured under said conditions.

* * * * *